US005796208A

United States Patent [19]

Girach

[11] Patent Number: 5,796,208

[45] Date of Patent: Aug. 18, 1998

[54] ELECTRODELESS FLUORESCENT LAMP WITH ONE-PIECE ELECTRICALLY INSULATIVE LAYER

[75] Inventor: Mahomed Hanif Girach, Leicester, England

[73] Assignee: General Electric Company, Schenectady, N.Y.

[21] Appl. No.: 730,800

[22] Filed: Oct. 17, 1996

[30] Foreign Application Priority Data

Oct. 18, 1995 [GB] United Kingdom ..... 9521374

[51] Int. Cl.[6] ..... H01J 1/62; H01J 63/04

[52] U.S. Cl. ..... 313/493; 313/483

[58] Field of Search ..... 313/492, 493, 313/483

[56] References Cited

U.S. PATENT DOCUMENTS

| | | | |
|---|---|---|---|
| 4,727,294 | 2/1988 | Houkes | 313/493 |
| 5,173,637 | 12/1992 | Sica | 313/493 |
| 5,412,280 | 5/1995 | Scott et al. | 313/493 |
| 5,412,289 | 5/1995 | Thomas et al. | 313/493 |
| 5,461,284 | 10/1995 | Roberts et al. | 313/493 |

*Primary Examiner*—Max H. Noori

*Attorney, Agent, or Firm*—Fay, Sharpe, Beall, Fagan, Minnich & McKee

[57] ABSTRACT

An electrodeless fluorescent lamp includes a glass envelope at least a portion of the outer surface of the glass envelope, being coated with an electrically conductive layer, and a housing made of metal which makes electrical contact with the electrically conductive layer, the bulb and housing being covered at least partially by a one-piece insulating sleeve.

15 Claims, 1 Drawing Sheet

ELECTRODELESS FLUORESCENT LAMP WITH ONE-PIECE ELECTRICALLY INSULATIVE LAYER

This invention relates to electrodeless fluorescent lamps.

Figure 1:
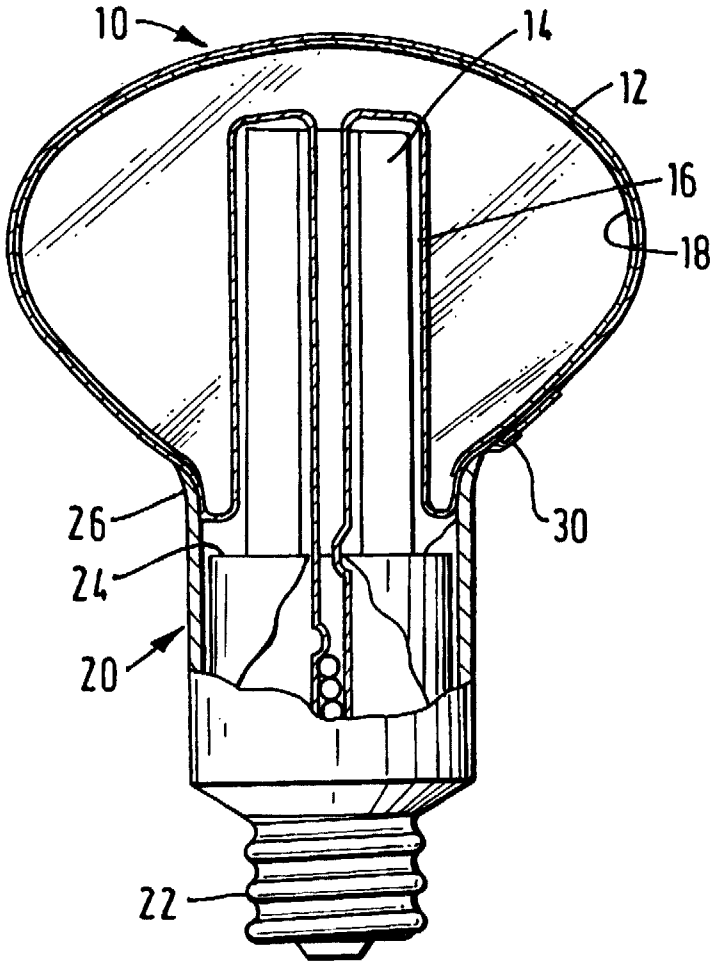
FIG. 1 PRIOR ART

A typical prior art electrodeless fluorescent lamp 10 is illustrated at FIG. 1. It has a discharge vessel 12 of glass containing an ionizable gaseous fill. A suitable fill, for example, comprises a mixture of a rare gas (e.g., krypton and/or argon) and mercury vapor and/or cadmium vapor. An excitation coil 14 is situated within a re-entrant cavity 16 within bulb 12.

The interior surfaces of the vessel 12 are coated in well-known manner with a suitable phosphor 18. The vessel 12 fits into one end of a base assembly 20 containing a radio frequency (RF) power supply (not shown) with a standard (e.g., Edison type) lamp cap 22 at the other end.

The RF power supply comprises a mains rectifier and an RF oscillator (neither shown) which are contained in a metal can 24 which is held at RF ground potential to suppress RF radiation. The can 24 is insulated by a rigid plastic housing 26. The plastic housing 26 surrounds the can and extends upwards to contact the vessel 12. The housing supports the can and its contents and the discharge vessel.

In operation, current flows in coil 14 as a result of excitation by the RF power supply. As a result, a radio frequency magnetic field is established within the vessel 12 and which excites the gaseous fill contained therein, resulting in an ultraviolet-producing discharge. The phosphor 18 absorbs the ultraviolet radiation and consequently emits visible radiation.

There are several disadvantages associated with such prior art lamps. The vessel 12 has an internal coating of light transmissive electrically conductive material to confine the RF within the vessel. A conductive layer is provided on the outer surface of the vessel capacitively coupled with the internal conductive coating. The outer layer is connected to RF ground via an electrical connection such as a foil. The connection is difficult to make. In addition, the can and housing constitute a significant cost of the lamp.

The present invention seeks to provide an improved discharge lamp. It comprises an electrodeless fluorescent lamp including a discharge vessel, at least of portion of the outer surface of the vessel being coated with light transmissive electrically conductive layer and a housing of metal which makes electrical contact with the electrically conductive layer and which supports the discharge vessel and energising circuits of the lamp, and the vessel and housing being covered at least partially by a one-piece insulative layer.

The metal housing of the present invention is readily manufactured by using well established metal punching techniques, obviating the need for a foil connection due to the direct contact of the metal housing and the electrically conductive layer surrounding the glass envelope as well as providing a good heat sinking ability. The direct connection may be made by a conductive adhesive or by contact of the cap with the electrically conductive layer.

The insulative layer functions to make the lamp electrically safe and may also fix or help to fix the discharge vessel to the metal housing. The layer does not support the housing and/or the discharge vessel.

The one-piece surrounding insulative layer provides a high degree of waterproofing and good insulation. Little or no adhesive is required to hold the discharge vessel to the housing. By making the lamp shatterproof the insulative layer extends the areas in which such discharge lamps can be employed into, for example, the food industry. The use of a conductive layer over the bulb's outer layer means the EM suppression is not dependent on the thickness of the glass envelope so allowing a reduction in manufacturing tolerances as regards thickness distribution of the glass envelope.

Figure 2:
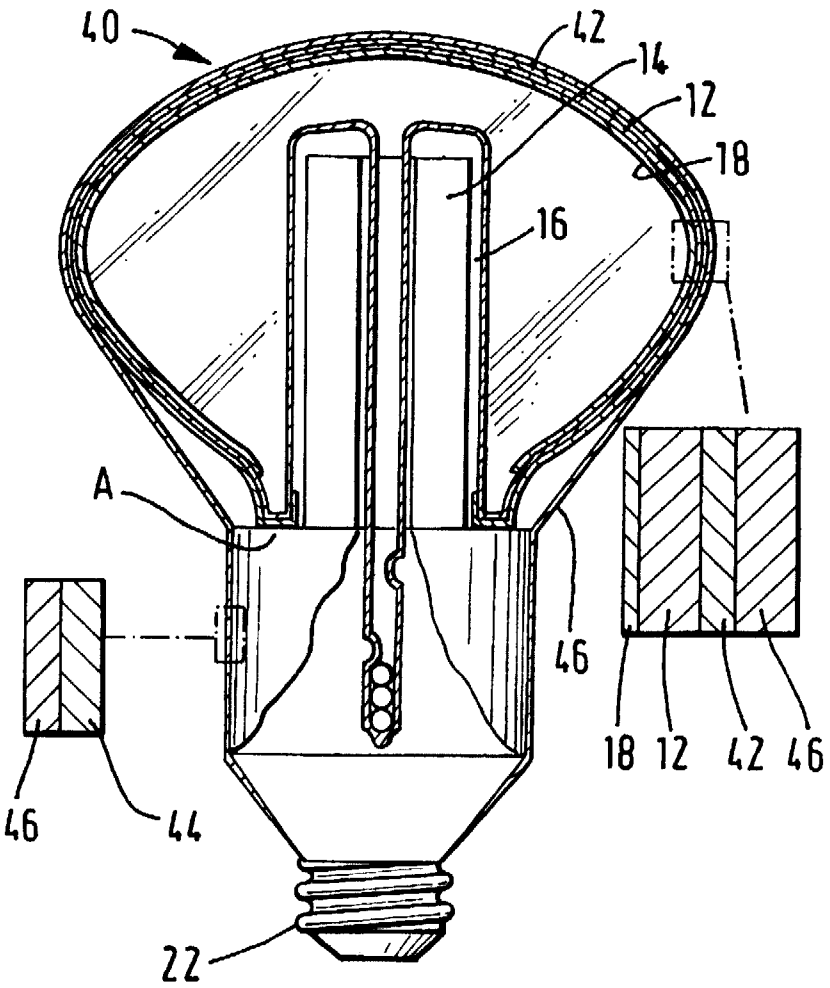

An embodiment of the invention will now be described, by way of example only, with reference to the accompanying drawings, of which:

FIG. 1 is a diagrammatic part cut-away cross-section of a prior art electrodeless fluorescent discharge lamp; and FIG. 2 is a diagrammatic part-cut away cross-section of an embodiment of the present invention.

FIG. 1 has already been described.

Referring now to FIG. 2, an embodiment 40 of the present invention is shown with those parts in common with the prior art lamp of FIG. 1 being denoted by the same reference numerals.

The glass discharge vessel 12 of the lamp has an external coating of electrically conductive light transmissive material, to provide EMI suppression.

The RF oscillator and rectifier (not shown) are contained within, and supported by, a metal stamped housing 44 which makes contact to the electrically conductive layer 42 at annular region A preferably via a thin conductive adhesive layer.

The vessel is supported directly or indirectly by the housing 44. In FIG. 2, the vessel 12 is supported directly by the housing 44 at region A.

The vessel 12, with its outer conducting layer 42, and the metal can 44 is covered by a one-piece electrically insulating sleeve 46.

It may prove practicable to dispense with the adhesive layer in region A in arrangements where the sleeve 46 holds the components together sufficiently tightly.

The sleeve 46 may be pre-formed and pulled over the bulb and housing or may be formed by dipping. Suitable materials are nylon and silicone but it is envisaged that other suitable materials can be used.

The material should be selected according to the proposed use of the lamp and manufacturing conditions, for example ease of manufacture, high voltage breakdown, good durability, heat resistance, clarity and long life are some considerations. The sleeve may be coloured.

Silicone sleeves are already used for colouring and waterproofing incandescent lamps and are available in a variety of shapes and sizes.

The housing 44 can be made of a single-piece punched metal can. This construction, compared to prior art plastics housings provides not only cost advantages for manufacture of the lamp but also provides improved strength. The metal can be selectively strengthened in specific regions by moulding rims and thickened areas using well-known techniques of metal product manufacture.

A lamp cap 22 is fixed to the metal housing 44. If the cap is a bayonet cap, a conventional bayonet cap may be used or the cylindrical portion of cap may be formed integrally with the housing 44 because the electrical contacts are insulated therefrom. If an Edison-screw cap is used, the screw threaded portion must be electrically isolated from the metal housing 44 which would otherwise be "live". The other contact of an Edison-screw cap is isolated from the screw-threaded portion.

I claim:

1. An electrodeless fluorescent lamp including a discharge vessel, the outer surface of the vessel being coated with a light transmissive electrically conductive layer, and a housing of metal which makes electrical contact with the electrically conductive layer and which supports the discharge vessel, a one-piece electrically insulative layer covering substantially the entirety of the housing and at least partially covering the vessel, the one-piece layer serving to insulate both the electrically conductive layer and the housing.

2. A lamp as claimed in claim 1 in which the insulative layer comprises nylon, silicone or other electrically insulative material.

3. A lamp as claimed in claim 1 in which the insulative layer is colored.

4. A lamp as claimed in claim 1 in which the vessel is fixed to the housing by electrically conductive adhesive which makes an electrical connection between the conductive layer and the housing.

5. A lamp as claimed in claim 1 wherein the insulative layer holds the metal housing and the discharge vessel together with the housing in electrical contact with the conductive layer.

6. A lamp as claimed in claim 1 wherein the insulative layer covers the whole of the vessel and housing.

7. A lamp as claimed in claim 5 wherein the insulative layer covers the whole of the vessel and housing.

8. A lamp as claimed in claim 2 in which the insulative layer is colored.

9. A lamp as claimed in claim 2 in which the vessel is fixed to the housing by electrically conductive adhesive which makes an electrical connection between the conductive layer and the housing.

10. A lamp as claimed in claim 3 in which the vessel is fixed to the housing by electrically conductive adhesive which makes an electrical connection between the conductive layer and the housing.

11. A lamp as claimed in claim 2 wherein the insulative layer holds the metal housing and the discharge vessel together with the housing in electrical contact with the conductive layer.

12. A lamp as claimed in claim 3 wherein the insulative layer holds the metal housing and the discharge vessel together with the housing in electrical contact with the conductive layer.

13. A lamp as claimed in claim 2 wherein the insulative layer covers the whole of the vessel and housing.

14. A lamp as claimed in claim 3 wherein the insulative layer covers the whole of the vessel and housing.

15. A lamp as claimed in claim 4 wherein the insulative layer covers the whole of the vessel and housing.

* * * * *